US008727156B2

(12) United States Patent
Skwarek et al.

(10) Patent No.: US 8,727,156 B2
(45) Date of Patent: May 20, 2014

(54) PACKAGE SUITABLE FOR STORING LIQUIDS

(75) Inventors: Gary Skwarek, Summit, NJ (US); Sam Tan, Summit, NJ (US)

(73) Assignee: Intervet Inc., Summit, NJ (US)

( * ) Notice: Subject to any disclaimer, the term of this patent is extended or adjusted under 35 U.S.C. 154(b) by 102 days.

(21) Appl. No.: 13/140,485

(22) PCT Filed: Dec. 18, 2009

(86) PCT No.: PCT/EP2009/067479

§ 371 (c)(1),
(2), (4) Date: Jun. 17, 2011

(87) PCT Pub. No.: WO2010/070081

PCT Pub. Date: Jun. 24, 2010

(65) Prior Publication Data

US 2011/0248030 A1 Oct. 13, 2011

Related U.S. Application Data

(60) Provisional application No. 61/139,058, filed on Dec. 19, 2008.

(51) Int. Cl.
*B65D 73/00* (2006.01)

(52) U.S. Cl.
USPC ..... 220/4.21; 215/49; 206/469; 206/532

(58) Field of Classification Search
CPC ..... B65D 75/58; B65D 75/585
USPC ..... 222/412.6, 541.6, 541.9, 107; 215/47, 215/48, 49; 383/200, 207, 208, 209; 206/528, 531, 532, 277, 469, 470, 484; 220/265; D9/696
See application file for complete search history.

(56) References Cited

U.S. PATENT DOCUMENTS

| | | | | |
|---|---|---|---|---|
| 5,111,932 | A | 5/1992 | Campbell | |
| 5,546,728 | A | 8/1996 | Dekeyser | |
| 6,329,047 | B1 * | 12/2001 | Beer et al. | 428/215 |
| 2007/0228073 | A1 * | 10/2007 | Mazzarino | 222/107 |

FOREIGN PATENT DOCUMENTS

| | | |
|---|---|---|
| WO | WO88/06558 | 9/1988 |
| WO | WO93/14003 | 7/1993 |
| WO | WO94/14356 | 7/1994 |

OTHER PUBLICATIONS

European Search Report for European Patent Application No. EP 08172423.

International Search Report for corresponding PCT/EP2009/067479, mailed on Apr. 27, 2010.

* cited by examiner

*Primary Examiner* — Jacob K Ackun
*Assistant Examiner* — Allan Stevens

(57) ABSTRACT

A package suitable for storing liquids therein, having a pocket (16) being formed between superposed front and rear sheets (10; 12), which are joined together peripherally by a liquid-tight seal (14), a top package portion comprising an end of a neck portion (20), which extends from the pocket (16), a top part (22) of the neck portion (20) being narrower than the pocket (16), at least one reinforcement portion (28) being arranged at the top package portion and extending on at least one side of the top part (22) of the next portion (20). The front sheet (10) and the rear sheet (12) each have a substantially uniform rupture strength along the extension of the pocket (16) and the neck portion (20). In order to open the package, the neck portion (20) is ruptured by bending the top package portion backwards.

8 Claims, 2 Drawing Sheets

PACKAGE SUITABLE FOR STORING LIQUIDS

RELATED APPLICATIONS

This application is a national stage entry under 35 U.S.C. §371 of PCT/EP2009/067479 filed on Dec. 18, 2009, which claims priority to U.S. Provisional Application Ser. No. 61/139,058 filed on Dec. 19, 2008. The content of PCT/EP2009/067479 is hereby incorporated by reference in its entirety.

The invention relates to a package suitable for storing liquids therein and, in particular, a veterinary package for storing and dispensing liquids.

Such packages are well known in the art and are, for example, used for applying anti flea fluids to the skin of cats or dogs. The contents are tightly sealed in the package, and the package is opened in order to dispense the contents, for example a liquid.

From US 2007/02280731 A1, a veterinary blister package for dispensing liquids is known having a bottom layer and thermoformed top (blister) layer sealed together at their respective peripheral edges. A liquid reservoir is enclosed between the superposed sheets including a funnel-shaped outlet passageway and a liquid discharge opening. The funnel-shaped outlet passageway extends across the liquid discharge opening. The liquid discharge opening is openable by folding a tab portion backwards about a score line that weakens the bottom layer and crosses the outlet passageway at the liquid discharge opening. At both ends of the score-line, notches are provided. Between the notches and the funnel shaped outlet passageway, reinforcing structures are provided, which extend across the score-line, in order to prevent the tab portion from being torn along the score-line when it is twisted relative to the base portion of the package.

U.S. Pat. No. 3,741,384 discloses a similar blister package wherein a score line in the bottom layer is used for defining the rupture point of the top blister layer and, therewith, defining the location of the discharge opening.

However, a score-line, or, in general, any notching of the layers of the package has the disadvantage of requiring a relatively expensive process step in manufacturing the package.

In the prior art several solutions are provided for overcoming the disadvantage of a score-line.

WO 88/06558 shows a blister package wherein the front sheet and the rear sheet have a substantially uniform rupture strength along the extension of the pocket and the neck portion, i.e. there is no weakened portion in the sheeting along the pocket and neck portion to obtain a preferred position at which the package will inevitably break open. In order to make sure however that the package will break open at a predetermined position, the neck portion of the blister itself is shaped such that there is a tension build up at the position where the neck portion should break when a bending force is applied to the blister package. This solution however has several disadvantages. Since the preformed neck is the only means that should provide the breaking up at the predetermined position, it is formed in a relatively robust manner which means that a relatively high force is needed to open the blister package. Due to this high force the breaking up process is highly uncontrolled which may lead to irregular breaking edges. Indeed, in the patent application it is already mentioned that it is desirable to facilitate the breaking operation by providing a cease line across the rear backing sheet immediately behind the predetermined breaking up position.

In WO 94/14356 yet another solution is chosen. In this blister package, there is provided a discontinuity in the sheeting along the neck portion, viz. notches are provided at the site where the neck portion should break open. In other words, the sheets do not have a substantially uniform rupture strength along the extension of the neck portion. This complicates the process of manufacturing such a package.

It is an object of the invention to provide a package suitable for storing liquids therein, which facilitates a controlled dispensing of the stored contents by a user and which is comparatively easy to manufacture.

According to the invention, this object is achieved by a package suitable for storing liquid therein, comprising:

- a front sheet,
- a rear sheet,
- a pocket being formed between the superposed front and the rear sheets, the front sheet and the rear sheet being joined together peripherally by a liquid-tight seal, and
- a neck portion extending from the pocket, for being ruptured by bending a top package portion backwards, at least a top part of the neck portion being narrower than the pocket, and the top package portion comprising an end of the neck portion wherein the front sheet and the rear sheet have a substantially uniform rupture strength along the extension of the pocket and the neck portion, wherein a reinforcement portion is arranged at said top package portion, which portion extends along the top part of the neck portion in a direction towards the pocket, on a left side of the neck portion, to and ending at a first position, and, on a right side of the neck portion, to and ending at a second position, the first and second positions being located on a straight line extending across the neck portion.

It has been found that a score-line can be dispensed with, and the package will nevertheless be ruptured in a well defined position, when a reinforcement portion is arranged along the top part of the neck portion as indicated here-above.

The front sheet and the rear sheet each have a substantially uniform rupture strength along the extension of the pocket and the neck portion. That is, neither the front sheet nor the rear sheet comprise, at least along the extension of the pocket and the neck portion, a score-line, a rupture line weakened by notching or any other result of an operation to provide a sudden (discontinuous) decrease in the rupture strength of each respective sheet. In other words, the material of the front sheet and the rear sheet is intact along the extension of the pocket and the neck portion. In a package according to the present invention the reinforcement portion extends, in a direction towards the pocket, at a left side of the neck portion, to and ending at a first position, and, at a right side of the neck portion, to and ending at a second position, the first and second positions being located on a straight line extending across the neck portion. For example, the straight line extends transverse across the neck portion. Preferably, the straight line is remote from the pocket. In this embodiment, in contrast for example with the arrangement known from U.S. Pat. No. 3,741,384, upon rupture of the rear sheet part of the neck portion remains intact and may advantageously be used as a guide to direct the content of the pocket to a subject, in particular e.g. upon administration of an anti flea fluid through the fur of an animal. The reinforcement portion extending to and ending at the first an second positions, respectively, facilitates the neck portion being ruptured approximately at said straight line by bending the top package portion backwards. This results from the reinforcement portion reinforcing the top package portion above the line. For example, the reinforcement portion may hinder the neck portion from being ruptured at a height next to the reinforcement portion. When the top package portion is bent backwards, the reinforcement portion may concentrate the applied bending stress at its lower ends, i.e. at the first and second positions. Thus, the package is likely to rupture approximately at the line connecting the first and second positions.

The pocket forms a storage reservoir. For example, the pocket is flexible. This allows for example dispensing a liquid contained in the reservoir by pressing the pocket. For example, the pocket and/or the package is pliable. For example, the pocket is formed in the front sheet, and the front sheet is flexible and/or pliable.

Useful details of the invention are indicated in the depended claims.

In one embodiment, the reinforcement portion comprises at least one cavity formed between the superposed front and rear sheets. A hollow cavity which, for example, extends in a longitudinal direction, has a larger bending resistance and break resistance than a flat, non-hollow superposition of the front and rear sheets, even if the rupture strength of the individual front sheet and rear sheets, respectively, is substantially uniform throughout the reinforcement portion and its surroundings. When providing a cavity, the reinforcement portion may be formed in the same manner and the same processing stage as the pocket, for example by thermoforming and stamping. For example, the seal seals the neck portion from the cavity.

In one embodiment, the neck portion comprises a first portion and a second portion adjoining the first portion at a junction, the neck portion forming a bend, in particular a sharp bend (I.e. a bend having a specific angle, not being substantially concave), at the junction, and the neck portion being adapted for being ruptured at the junction by bending said top package portion backwards. Due to the bend, a tension may build up at the position of the bend, when the top package portion is bent backwards. This further facilitates rupturing the neck portion at a desired position. For example, there may be a discontinuity in the shape of the neck portion at the junction.

For example, the junction is located adjacent to (i.e. abutting, coinciding with or at least nearby) the straight line mentioned above. Thus, both the reinforcement portion and the bend in the neck portion will concentrate bending stress approximately at said straight line, when the top package portion is bent backwards.

In one embodiment, the pocket and/or the neck portion tapers towards a top part of the neck portion. For example, the first portion of the neck portion is straight, i.e. has a substantially uniform cross section, and the second portion of the neck portion tapers towards the first portion. Thus, there is a discontinuity in the shape of the neck portion at the junction of the first and second portion, and a bend is formed at said junction. When the pocket and/or the neck portion taper towards the neck portion, the rupture of the neck portion will create a comparatively small opening for dispensing the liquid. The opening will be remote from the larger part of the pocket. This facilitates controlling the dispensing of a liquid by a user, i.e. the dosing of the liquid.

In one embodiment, the pocket and the neck portion are formed in the front sheet. For example, the cavity of the reinforcement portion may also be formed in the front sheet, that is, e.g. a bulge or a channel forming the cavity may be formed in the front sheet. For example, the rear sheet is substantially flat. This simplifies manufacturing the package.

For example, the front sheet is a thermoformable sheet. For example, the front sheet comprises an amorphous polymer, preferably is constituted substantially completely from such a polymer (wherein the term polymer also includes a mixture of polymeric materials) such that the front sheet can be regarded as being constituted from an amorphous material. An amorphous material can resist some deformation, but when the deformation is too large, an amorphous material behaves like a brittle material and breaks. This is an ideal combination of properties for forming the pocket and, in particular, the neck portion of the package.

A preferred embodiment of the invention will now be described in conjunction with the drawings, in which.

Figure 1:
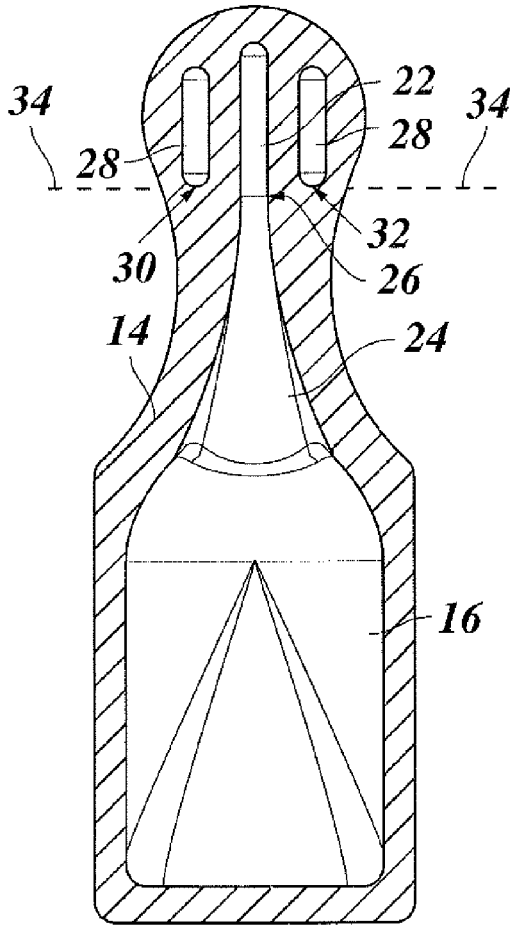
FIG. 1 is a front view of a package according to the invention.
Figure 2:
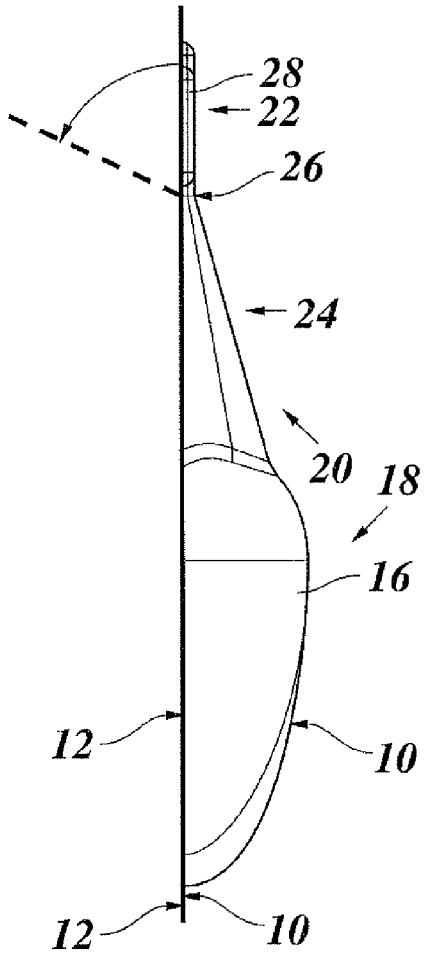
FIG. 2 is a side view of the package of FIG. 1.

FIG. 1 and FIG. 2 schematically show a package for storing liquids therein. The package consists of a front sheet and a rear sheet 12. The sheets 10 and 12 are superposed and joined together by a peripheral liquid-tight seal in a circumferential seal area 14. The seal area 14 is indicated in FIG. 1 by hatching.

In the front sheet 10, a pocket 16 for storing liquid is formed. The pocket 16 has a main part 18 of a comparatively large cross section and tapers towards a neck portion 20 extending from the pocket 16 in a longitudinal direction. The neck portion 20 consists of an upper, first portion 22 and a lower, second portion 24. The second portion connects the pocket 16 to the first portion 22 and tapers from the pocket 16 towards a junction 26 to the first portion 22. The first portion 22 has a substantially uniform cross section. Thereby, a sharp bend is formed in the front sheet 10 at the junction 26. The neck portion 20 is funnel-shaped.

Next to the first portion 22 of the neck portion, at the left side and at the right side of the neck portion 20, channels 28 are formed in the front sheet 10, which form cavities between the front and rear sheets 10, 12. The seal area 14 surrounds the channels 28. Thereby, the channels 28 form reinforcement portions. The channels 28 extend, in the direction towards the pocket 16, up to a first position 30 and a second position 32, respectively, at which positions the channels end.

The first position 30, the second position 32 and the junction 26 are situated approximately on a straight line 34, which is transverse to a longitudinal direction of the neck portion 20. The junction 26 is positioned slightly below a line connecting the first and second positions 30, 32. From the pocket 16 towards the top end of the neck portion 20, the lateral extension of the package decreases along the second portion 24 of the neck portion and then increases again and reaches a local maximum extension in the area of the reinforcement portions.

Aside from the pocket 16, neck portion 20, and channels 28 being formed in the front sheet 10, the front sheet 10 has a substantially uniform rupture strength throughout and, in particular, along the extension of the neck portion 20. An example of the polymer material of the front sheet 10 will be describes below with reference to FIG. 5.

The rear sheet 12 is substantially flat and also has a substantially uniform rupture strength throughout and, in particular, along the extension of the neck portion 20.

The pocket 16 is filled with a liquid, for example, an anti-parasitic drug, in particular, an anti-flea and anti-tick agent. For example, the pocket 16 is filled to an extent such that at least the first portion 22 of the neck portion is empty, when the package is held in an upright configuration. For example, the pocket 16 may contain a few milliliters of liquid. For example, the total volume of the pocket 16 and the neck portion 20 may be approximately 7 ml.

A user may open the package as follows. When the top package portion, e.g. the portion above the line 34, including the reinforcement portion 28, is bent backwards as is indicated by an arrow and a dashed line in FIG. 2, the neck portion 20 will rupture at the line 34. Thus, the neck portion 20 will break at approximately that height, where the reinforcement portions 28 end. Thereby, a discharge opening is created at the now ruptured junction 26. At this position, the neck portion 20 has a comparatively small cross section. Thus, by pressing the pocket 16, the user may discharge the liquid from the pocket 16 in a controlled manner. Thus, the second part 24 of the neck portion 20 forms a dosing funnel, which substantially remains intact to serve as a guide for enabling the secure dosing of the liquid, e.g., through the fur or coat of an animal. Only the tip of the neck portion, that is, the first portion 22, breaks away upon opening of the package.

Figure 3:
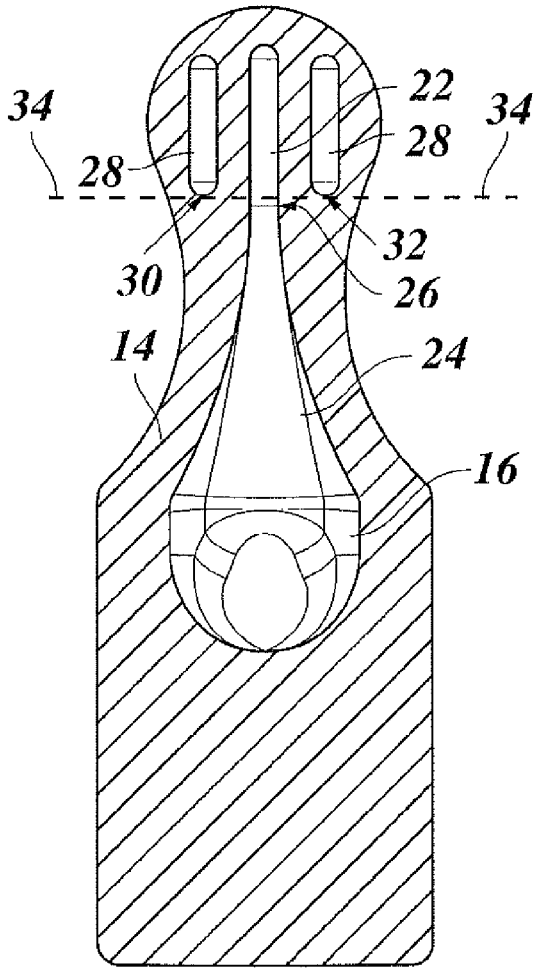
FIG. 3 is a front view of a further embodiment of a package.
Figure 4:
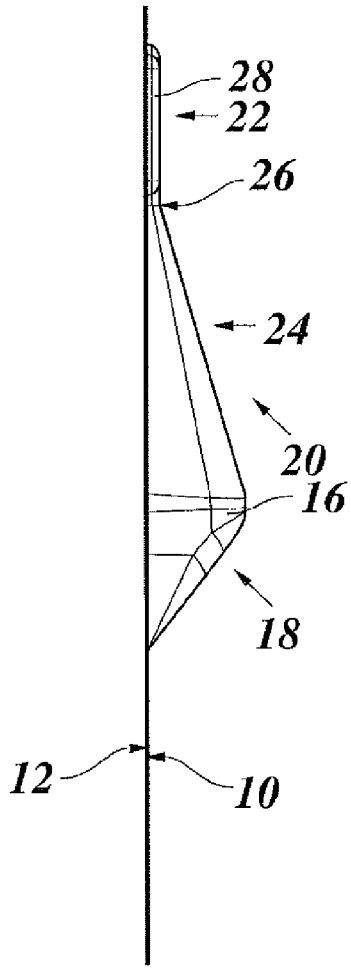
FIG. 4 is a side view of a package of FIG. 3.

FIG. 3 and FIG. 4 show a further embodiment of the package, which differs from the embodiment of FIGS. 1 and 2 in that the pocket 16 has a smaller volume. The pocket 16 has a maximum cross section at a junction to the second portion 24 of the funnel-shaped neck portion 20. The top first portion 11 of the neck portion is narrower than the pocket 16. For example, the pocket 16, including the neck portion 20, may contain an amount of approximately 1 to 2 ml or an amount of less than 1 ml of liquid. For example, the total volume of the pocket 16 and the neck portion 20 may be approximately 1.5 ml.

Figure 5:
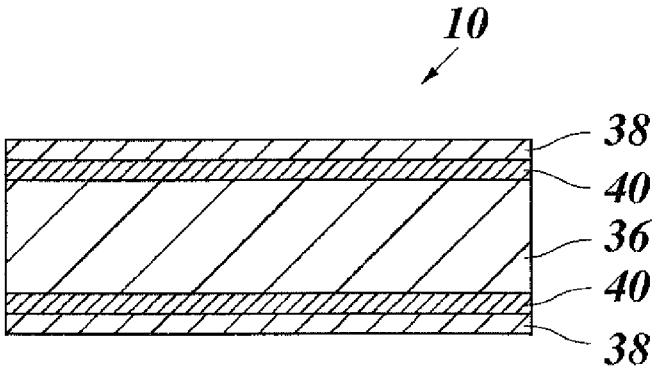
FIG. 5 is a schematic partial cross-sectional view of a top sheet of a package.

FIG. 5 schematically shows the structure of the front sheet 10 in one embodiment of the invention. The front sheet 10 has a multilayer structure comprising an inner layer 36 of a cyclo-olefin-copolymer (COC) of, for example, a thickness of 300 micrometer. The COC material is an amorphous polymer.

This polymer is, for example, provided as a cast extruded film. The layer 36 forms a barrier film for sealing the pocket 16. For example, the layer 36 is laminated between two layers 38 of polypropylene (PP). For example, the PP layers 38 may be connected to the layer 36 by respective adhesive or tie layers 40. For example, the layers 38 and the tie layers 40 each have a thickness of 20 micrometer. For example, the front sheet 10 is translucent, so that the liquid contained in the pocket 16 is visible. Such a sheet 10 may for example be obtained from ALCAN Packaging (Kreuzlingen, Germany) under the trade name POLYBAR®.

For example, the pocket 16 and the neck portion 20, as well as the reinforcement portions 28, are formed in the front sheet 10 by thermoforming.

For example, the rear sheet 12 is an aluminium foil. For example, the rear sheet 12 is sealed to the front sheet 10 with a sealing lacquer as is known in the art of blister packages.

The invention claimed is:

1. A package suitable for storing liquids therein, comprising:

a front sheet (10), and a rear sheet (12), the front sheet being superposed onto the rear sheet and the front sheet and the rear sheet being joined together peripherally by a liquid-tight seal (14), a pocket being formed between the superposed front and rear sheets (10;12), a neck portion (20) extending from the pocket (16) into a top portion of the package, wherein the neck portion can be ruptured by bending the top portion of the package backwards, wherein at least a top part (22) of the neck portion (20) is narrower than the pocket (16), and the top portion of the package comprising an end of the neck portion (20), wherein neither the front sheet (10) nor the rear sheet (12) comprise, at least along the extension of the pocket (16) and the neck portion (20), a score-line, a rupture line weakened by notching or any other result of an operation to provide a sudden discontinuous decrease in rupture strength of each respective sheet, wherein at least one reinforcement portion (28) is arranged at said top portion of the package, which portion (28) extends along the top part (22) of the neck portion (20) in a direction towards the pocket (16), on a left side of the neck portion (20), to and ending at a first position (30), and, on a right side of the neck portion (20), to and ending at a second position (32), the first and second positions (30; 32) being located on a line (34) extending across the neck portion (20).

2. The package according to claim 1, wherein the reinforcement portion (28) comprises at least one cavity formed between the superposed front and rear sheets (10; 12).

3. The package according to claim 1, wherein the neck portion (20) comprises a first portion (22) and a second portion (24) adjoining the first portion (22) at a junction (26), the front sheet (10) can be bent at the junction (26), resulting in the neck portion (20) being ruptured at the junction (26).

4. The package according to claim 3, wherein the junction (26) is located adjacent to the line (34).

5. The package according to claim 1, wherein the pocket (16) and/or the neck portion (20) tapers towards the top part (22) of the neck portion (20).

6. The package according to claim 1, wherein the pocket (16) and the neck portion (20) are formed in the front sheet (10).

7. The package according to claim 1, wherein the front sheet (10) comprises an amorphous polymer.

8. The package according to claim 1, wherein the front sheet (10) comprises a cyclo-olefin-copolymer layer (36).

* * * * *